United States Patent [19]

Kandabashi

[11] 3,958,387

[45] May 25, 1976

[54] TRANSVERSE ROOFING STRIP

[76] Inventor: Sadao Kandabashi, 1-1, 2-chome, Takanoo, Miyakonojo, Miyazaki, Japan

[22] Filed: Mar. 17, 1975

[21] Appl. No.: 559,388

[30] Foreign Application Priority Data

Mar. 20, 1974 Japan ..... 49-32844[U]

[52] U.S. Cl. ..... 52/531; 52/535

[51] Int. Cl.[2] ..... E04D 1/06; E04D 3/16

[58] Field of Search ..... 52/529–532, 52/535

[56] References Cited

UNITED STATES PATENTS

| | | | |
|---|---|---|---|
| 422,571 | 4/1890 | Cooper | 52/529 |
| 762,939 | 6/1904 | Pioch | 52/531 |
| 1,706,924 | 3/1929 | Kane | 52/529 |
| 1,743,206 | 1/1930 | Fulenwider et al. | 52/529 |
| 2,027,321 | 1/1936 | Rateike | 52/531 |
| 3,733,767 | 5/1973 | Craike | 52/529 |

FOREIGN PATENTS OR APPLICATIONS

| | | | |
|---|---|---|---|
| 5,769 | 10/1909 | United Kingdom | 52/530 |

*Primary Examiner*—Ernest R. Purser
*Assistant Examiner*—James L. Ridgill, Jr.
*Attorney, Agent, or Firm*—Stevens, Davis, Miller & Mosher

[57] ABSTRACT

A roofing strip capable of perfectly preventing permeation of rain water due to the phenomenon of capillary attraction is disclosed, which roofing strip has as its salient feature the profile of an oblong iron sheet wherein the upper edge X thereof is shaped into fourfold upward bends 1, 2 and 3, the bend 1 contains a semicircular arching ridge 4, the portion of the sheet extending from the bend 1 toward the lower edge Y is bent at a position close to the lower edge Y to form an upward inclination 5 at an angle of about 160°, the upward inclination 5 is bent at its other extremity to form a parallel portion 6 relative to the portion of iron sheet intervening between the bend 1 and the base of the upward inclination 5, the parallel portion 6 is bent first downwardly into a vertical bend 7 and then sidewise into a reverse bend 8 having a semicircular arching ridge 9, which oblong iron sheet A is characterized by having the reverse bend 8 provided with an additional bend folded in the opposite direction and terminated with a downwardly arcuate curve.

7 Claims, 6 Drawing Figures

TRANSVERSE ROOFING STRIP

BACKGROUND OF THE INVENTION a. Field of the Invention

This invention relates to a roofing material, and more particularly to an improvement of the transverse roofing strip of the applicant's former invention involved in Japanese Utility Model Application No. 10686/1971 (Utility Model Laying Open No. 62822/1973).

b. Description of the Prior Art

In the conventional transverse roofing strip of iron sheet, hollows occur along its folded joint between the iron sheet and the tacks. When they are stepped upon by a person walking on the roof said hollows are easily dented. Further, the folded joint thereof is frail as a whole and, therefore, tends to suffer leakage of rain water. Thus these and other drawbacks have been attendant upon the conventional roofing strip. Japanese Utility Model Application No. 10686/1971 filed by the applicant has aimed to provide a transverse roofing strip of iron sheet designed to provide a folded joint strong enough to ensure perfect prevention of leakage of rain water and at the same time give a roof having the curvilinear beauty of a tiled roof. It has been confirmed through experiments that the transverse roofing strip according to said Utility Model Application No. 10686/1971 does not experience any leakage of rain water even under conditions of a typhoon with a wind velocity of 80 meters, indicating that it serves substantially perfectly as an iron-sheet roof for ordinary purposes.

SUMMARY OF THE INVENTION

The present invention is directed to a roofing material adapted for the formation of an iron-sheet roof in districts having heavy snowfall as well as in districts experiencing heavy rainfalls. To be specific, this invention provides a transverse roofing strip comprising, in combination, (A) an oblong iron sheet member of a design wherein the upper edge X thereof is shaped into four-fold upward bends 1, 2 and 3, said bend 1 contains a semicircular arching ridge 4, the portion of the sheet extending from the bend 1 toward the lower edge Y is bent at a position close to the lower edge Y to form an upward inclination 5 at an angle of about 160°, the upward inclination 5 is bent at its other extremity to form a parallel portion 6 relative to the portion of iron sheet intervening between the bend 1 and the base of the upward inclination 5, said parallel portion 6 is bent first downwardly into a vertical bend 7 and then sidewise into a reverse bend 8 in the direction of the upper edge X and said reverse bend 8 having has a semicircular arching ridge 9, which oblong iron sheet A is characterized by having said reverse bend 8 provided with an additional bend 11 folded in the opposite direction and terminated with a downwardly arcuate curve 10. The invention also includes (B) an oblong iron-sheet point tack of a design wherein one end thereof is shaped into a right-angled upward bend 12 and an inverted-V-shaped bend 13, the forward portion thereof is folded at the left extremity of said inverted-V shaped bend 13 downwardly in the opposite sidewise direction to form an opposite bend 14, the forward portion of said opposite bend 14 is folded upwardly at the righthand end of said opposite bend 14 by a right angle to form a rising portion 15, the forward portion of said rising portion 15 is folded to form a parallel bend 16 relative to the opposite bend 14 and the forward end of said parallel bend 16 is folded backwardly to form an opposite bend 17.

In the case of the roof of a house built in a district of heavy snowfalls, when the eaves are frozen and the interior rooms are kept warm, the lower layer of the snow on the roof is melted and the water from the molten snow seeps through the joints of roof sheets owing to the phenomenon of capillary attraction, causing a leak in the roof. Seeping of water also occurs when rain drops are blown against the roof in a storm. The present inventon aims to offer a measure to cope with such difficulties and at the same time provide a roofing material more perfect in function than the conventional roofing iron sheet and capable of producing a roof of the curvilinear beauty of a tiled roof.

DETAILED DESCRIPTION OF THE INVENTION

Figure 1:
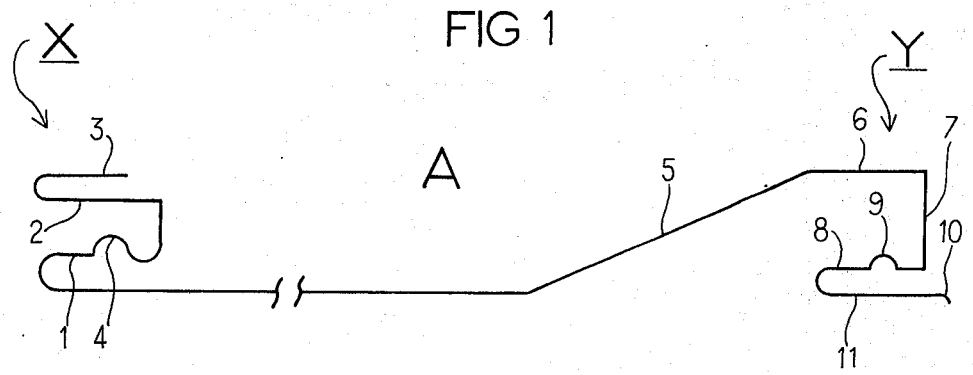
FIG. 1 is a diagram showing the cross section of an oblong iron sheet member A according to the present invention.
Figure 2:
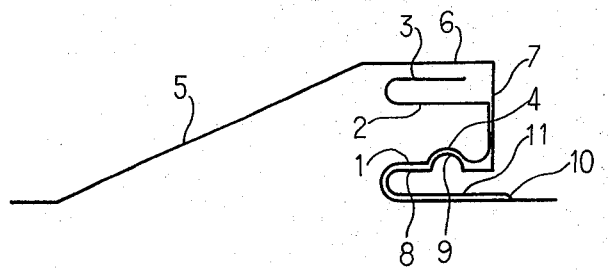
FIG. 2 is a sectional view illustrating a joint formed by coupling in position the upper edge of one member A and the lower edge of another member A.
Figure 3:
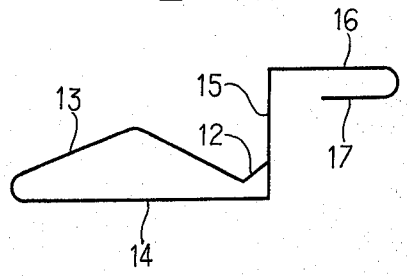
FIG. 3 is a diagram showing the cross section of a joint tack for the oblong iron sheet member according to the present invention.

This invention resides in the combination of (A) an oblong iron sheet member of a design wherein the upper edge X thereof is shaped into four-fold upward bends 1, 2 and 3, said bend 1 contains a semicircular arching ridge 4, the portion of the sheet extending from the bend 1 toward the lower edge Y is bent at a position close to the lower edge Y to form an upward inclination 5 at an angle of about 160°, the upward inclination 5 is bent at its other extremity to form a parallel portion 6 relative to the portion of iron sheet intervening between the bend 1 and the base of the upward inclination 5, said parallel portion 6 is bent first downwardly into a vertical bend 7 and then sidewise into a reverse bend 8 in the direction of the upper edge X and said reverse bend 8 has a semicircular arching ridge 9, which oblong iron sheet A is characterized by having said reverse bend 8 provided with an additional bend 11 folded in the opposite direction and terminated with a downwardly arcuate curve 10. The invention also includes (B) an oblong iron-sheet joint tack of a design wherein one end thereof is shaped into a right-angled upward bend 12 and an inverted-V-shaped bend 13, the forward portion thereof is folded at the left extremity of said inverted-V-shaped bend 13 downwardly in the opposite sidewise direction to form an opposite bend 14, the forward portion of said opposite bend 14 is folded upwardly at the righthand end of said opposite bend 14 by a right angle to form a rising portion 15, the forward portion of said rising portion 15 is folded to form a parallel bend 16 relative to the opposite bend 14 and the forward end of said parallel bend 16 is folded backwardly to form an opposite bend 17.

Figure 4:
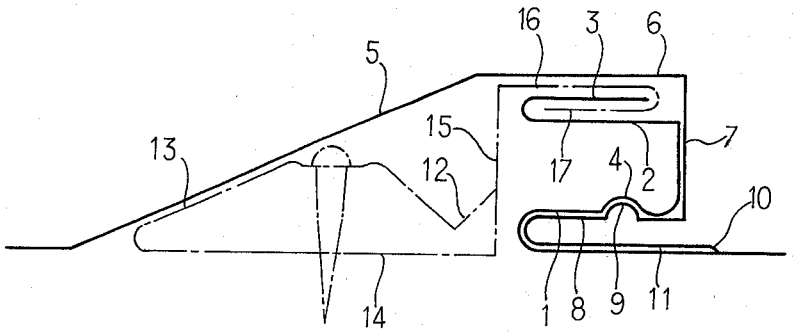
FIG. 4 is a sectional view showing a joint formed by fastening to the tack B the upper edge X of one member A and the lower edge Y of another member A.
Figure 5:
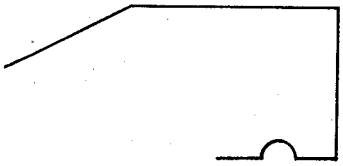
FIG. 5 is a diagram showing the cross section of the lower edge of an unimproved oblong iron-sheet strip and FIG. 6 is a diagram showing the cross section of an unimproved oblong iron-sheet tack. A denotes the oblong iron-sheet roofing strip according to the present invention, X the upper edge of said strip, Y the lower edge thereof and B the tack for use therein. The reference numerals 1 through 14 are for the parts composing the member A; 1, 2 and 3 denoting bends formed in the upper edge, 4 a semicircular arching ridge, 5 a rising inclination, 6 a parallel portion in the lower edge, 7 a vertical bend and 8 a reverse bend respectively therein, 9 a semicircular arching ridge, 10 an arcuate curve and 11 a bend. The reference numerals 12 through 17 are for the parts composing the tack A; 12 denoting a right-angled upward bend, 13 an inverted-V-shaped bend, 14 an opposite bend, 15 a rising portion, 16 a parallel bend and 17 an opposite bend.

The dominant feature of the present inventon resides in additionally incorporating a bend 11, the forward end of which is shaped in a downwardly arcuate curve 10, into the folds constituting the lower edge of the member A. In contrast, the lower edge of the transverse roofing strip of iron sheet disclosed by Japanese Utility Model Application No. 10686/1971 terminates in a folded portion as illustrated in FIG. 5 and, therefore, has a possibility of permitting water to seep through the joint by virtue of the phenomenon of capillary attraction. The addition of the bend 11 whose forward end is shaped in a downward arcuate curve 10 serves the purpose of preventing the transverse roofing strip from possible leakage of water through the joint when rain drops are blown against the roof by a wind blowing in an upwardly inclined direction or when the snow on the roof melts in the cold district having heavy snowfall. According to the present invention, the union of the upper edge X and the lower edge Y of the member A with the tack (B) gives rise to a joint composed of a total of nine layers as shown in FIG. 4, permits the semicircular arching ridge 4 formed in the bend 1 of the upper edge X to come into snag engagement with the semicircular arching ridge 9 formed in the reverse bend 8 of the lower edge Y respectively of the member A and, in addition, enables the arcuate curve 1 at the forward end of the bend 11 of the lower edge Y of the member A to be brought into pressing contact with the upper surface of the member A falling in the lowermost face of the joint. These tight engagements of the component parts synergistically cooperate to ensure complete prevention of leakage of water through the joint owing to the phenomenon of capillary attraction when rain drops are blown in an upwardly inclined direction against the joint by a strong wind or when the snow is melting. Thus, the bend 11 having the forward end thereof shaped in a downwardly arcuate curve 10 according to the present invention has a highly significant effect to fulfill.

Possessed of the construction described above, the present invention first requires the joint tack B to be laid transversely on the roof as indicated by a dotted line in the diagram of FIG. 4 and immobilized onto the roof by means of nails which are driven into position by a hammer from above the inverted-V-shaped bend 13 of the tack B. These nails are driven at fixed intervals and the points of the tack at which they are driven are dented to some extent. Since the inverted-V-shape of the tack B as a whole is retained substantially intact, the function of the tack B to retain the rising inclination 5 of the oblong iron-sheet member A placed to cover the tack B and hold the joint of the member A is not at all affected. The ordinal length of the tack B of the present invention is about 180 cm but its size may be adjusted to meet that of the member A, so that the tack (B) may be used in various sizes.

The rising inclination 5 in the lower edge Y of the member A is reinforced because it is held up by the inverted-V-shaped bend 13 of the joint tack B. The joint thus formed makes a good appearance because no hollow occurs inside the joint and also because the tack B is completely kept out of sight. Further, the tack itself has an added strength, because the rising portion 15 of the tack is diagonally pushed by the right-angled upward bend 12 of the tack.

Accordingly, the lower edge Y of one member A and the upper edge X of another member A are joined and at the same time the tack B serves to fasten the joint of said two members A to the roof by first bringing the portion and bends 6, 8 and 11 of the lower edge Y of the oblong iron-sheet member A into engagement, with the parallel bend 6 and the vertical bend at the lower end of the tack for thereby joining the tack B and the lower edge Y of the oblong iron-sheet member A, and subsequently bringing the bends 3, 2 and 1 at the upper edge X of another oblong iron-sheet member A into engagement with the bends 16 and 17 of the tack B and the portion and bends 6, 8 and 11 of the member A. In the consequence of the engagement obtained as described above, the semicircular arching ridge 9 formed in one edge of another member A is brought into fast engagement with the semicircular arching ridge 4 in the upper edge X of the member A.

Figure 6:
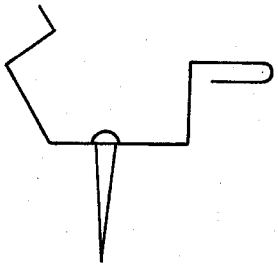

According to the invention of the applicant involved in Utility Model Application No. 10686/1971, the tack B is fabricated in an open form as shown in FIG. 6. The tack in such form is conveyed to the site of roofing work, fastened with nails to the roof and then folded so that the open portion thereof will form a bend to permit engagement of the member A. The tack in such an open form inconveniences the conveyance and complicates the field work. In view of these disadvantages, the present invention has the tack fabricated directly in a form in which it can be used without modification at the site of roofing. Thus, use of this tack proves highly advantageous and convenient from the standpoint of conveyance and field work. The materials of the transverse roofing strip of the present invention are iron sheet, copper sheet, aluminum sheet, steel sheet coated with polyvinyl chloride resin and stainless steel sheet, for example. Colorful roofs can be produced by applying various colors to the surface of such sheets.

The roofing materials according to the present invention, further, can be used for roofs of all types of houses and buildings, irrespectively of whether they are wooden houses, steel-frame houses or prefabricated houses.

The roofing material according to the present invention was tested for 1 water-tightness and 2 durability to wind pressure. The results are shown below.

| | Water-tightness test Condition of water leakage | |
|---|---|---|
| Pressure difference (kg/m²) | Conventional product | Product of the present invention |
| 15 (7–23) | No leakage | No leakage |
| 25 (12–38) | " | " |
| 40 (20–60) | One point of leakage detected | " |
| 60 (30–90) | " | " |
| 80 (40–120) | Two points of leakage | " |

-continued

| Pressure difference (kg/m²) | Water-tightness test Condition of water leakage: Conventional product | Product of the present invention |
|---|---|---|
| 100 (50–150) | detected Five points of leakage detected | " |

Note 1)
The test was carried out in accordance with the method prescribed by JIS A-1414.

Note 2)
Test conditions
a) Gradient of roof - 25/10
b) Duration of application of pressure - 10 minutes
c) Amount of water sprayed - 4 liters/min.
d) The roof for the test was formed of the roofing material subjected to test which was laid directly on the batten, with nothing interposed therebetween.
Note 3)
The maximum pressure was fixed at 150 kg/m² (equivalent to 49 m/sec of wind velocity).

WIND PRESSURE DURABILITY TEST

The durability to wind pressure was tested by determining the degree of deformation in accordance with the method for measurement of uniform load by air pressure (static and dynamic pressure).

| Load (kg/m²) | Portion tested | Maximum deflection (mm) | Ratio of deflection | Condition of deformation |
|---|---|---|---|---|
| Static pressure | | | | |
| Positive pressure 350 | Main house | 7.1 | 1/282 | As a whole, the deflection was small and the residual displacement was also small because the test structure contained both cross-beams and struts at the center. |
| | Surface of roofing material | 6.0 | 1/333 | |
| Negative pressure 200 | Main house | 38.2 | 1/105 | No abnormal phenomenon was observed. |
| | Surface of roofing material | 37.0 | 1/108 | The roof floated up as a whole from the batten after the nails fastening the batten at the verge to the common rafter had come loose. |
| Negative pressure 250 | Main house | 50.8 | 1/79 | The trend was the same as with F = 200 kg/m², except the deflection increased with the increasing magnitude of load. |
| | Surface of roofing material | 51.0 | 1/78 | |
| Dynamic pressure | | | | |
| Negative pressure 210 | Main house | 40.0 | 1/100 | Same as above |
| | Surface of roofing material | 39.3 | 1/102 | |

From the foregoing results, it is seen that under the static negative pressure of 250 kg/m² deflection was observed to occur in the surface of the roofing material. Under the static negative load of 280 kg/m², the roof experienced breakage after the nails had come out from the common rafter. Even in this case, the seams in the roofing materials, and the joint of the roofing material and the batten were not forced apart. The roofing materials and their seams formed in accordance with the present invention were not observed to suffer from any abnormality even at static negative pressures beyond the level of 300 kg/m². This indicates that the roof will remain intact in so far as the wooden members used underneath are perfect.

The transverse roofing strips according to the present invention are to be laid transversely, with the upper end X of each member A placed in the direction of the ridge of the roof and the lower edge Y thereof placed in the direction of the eave. It is easier to work than the conventional roofing iron-sheet strips and permits 30% of labor savings. It provides a finished roof having a better appearance or the ordinary tiled roof. The members A are placed in position without sustaining any scar or scratch as may be inflicted on others by hammering or some other similar work and, therefore, can be reused when the roof is renewed. The joints of the roof do not have hollows, so that the pressure of the foot of a person walking on the roof does not dent the joints. Thus, the roofing material of the present invention has numerous advantages, including those enumerated above.

I claim:

1. A transverse roofing strip, comprising:

a. an oblong sheet member (A) including;

i. an upper edge (X) having four-fold upward bends (1), (2) and (3), including a first bend (3), a second bend (2) connected at one end to said first bend (3) and extending from said one end in a direction opposite said first bend (3), a third bend (1) connected at one end to the other end of said second bend (2) and extending from said one end of said third bend (1) first in the opposite direction of said second bend (2) and then in the same direction as said second bend (2), said third bend (1) extending first in the opposite direction having a fist semicircular arching ridge (4);

ii. a lower edge (Y);

iii. a sheet portion extending from said third bend (1) toward said lower edge (Y) to interconnect said upper edge (X) and said lower edge (Y); said portion including a first horizontal part, and a second part (5) extending from said first part and bent at a position close to said lower edge (Y) to provide an upward inclination at an angle of about 160° from said first part;

iv. said lower edge (Y) including a portion (6) connected at one end to said second part and parallel to said first part, a vertical bend (7) connected at one end to the other end of said parallel portion (6), a reverse bend (8) connected at one end to the other end of said vertical bend (7) and extending in the direction of said upper edge (X), said reverse bend (8) having a second semicircular arching ridge (9), and an additional bend (11) connected at one end to the other end of said reverse bend (8) and extending in a direction opposite to the direction of said reverse bend (8), said additional bend (11) having another end (10) which is downwardly arcuately curved; wherein said first arching ridge of one transverse roofing strip may be placed in snag engagement with said second arching ridge of another transverse roofing strip; and b. an oblong sheet point tack (B), which is covered by said oblong sheet member, for retaining said second part (5); said point tack including a right angled upward bend (12) and an inverted-V-shaped bend (13) connected at one end to said upward bend (12), a bend (14) having one end folded downwardly from the other end of said inverted-V-shaped bend (13) and extending oppositely said inverted-V-shaped bend (13) in the direction of said upward bend (13), a rising portion (15) connected at one end to the other end of said oppositely extending bend (14) and extending upwardly and at a right angle from the other end of said oppositely extending bend (14), a parallel bend (16) extending at one end from the other end of said rising portion (15), said parallel bend (16) extending parallel to said oppositely extending bend (14), said parallel bend (16) and said oppositely extending bend (14) extending on opposite sides of said rising portion (15), and a bend (17) having one end folded from the other end of said parallel bend (16) and extending oppositely said parallel bend (16) back towards said rising portion (15).

2. A transverse roofing strip according to claim 1 wherein said oblong sheet member and said oblong sheet point tack are made of iron sheet.

3. A transverse roofing strip according to claim 1 wherein said oblong sheet member and said oblong sheet point tack are made of copper sheet.

4. A transverse roofing strip according to claim 1 wherein said oblong sheet member and said oblong sheet point tack are made of aluminum sheet.

5. A transverse roofing strip according to claim 1 wherein said oblong sheet member and said oblong sheet point tack are made of steel sheet coated with polyvinyl chloride resin.

6. A transverse roofing strip according to claim 1 wherein said oblong sheet member and said oblong sheet point tack are made of stainless steel sheet.

7. A transverse roofing strip according to claim 1 wherein said oblong sheet point tack may comprise various sizes.

* * * * *